US006068043A

United States Patent [19]

Clark

[11] Patent Number: 6,068,043

[45] **Date of Patent: *May 30, 2000**

[54] METHOD AND APPARATUS FOR NUCLEATED FORMING OF SEMI-SOLID METALLIC ALLOYS FROM MOLTEN METALS

[75] Inventor: William Eugene Clark, Arkadelphia, Ark.

[73] Assignee: Hot Metal Technologies, Inc., Arkadelphia, Ark.

[ * ] Notice: Under 35 U.S.C. 154(b), the term of this patent shall be extended for 664 days.

[21] Appl. No.: 08/578,047

[22] Filed: Dec. 26, 1995

[51] Int. Cl.[7] ..... B22D 17/12; B22D 23/00

[52] U.S. Cl. ..... 164/46; 164/113; 164/900

[58] Field of Search ..... 164/900, 46, 71.1, 164/113, 312

[56] References Cited

U.S. PATENT DOCUMENTS

| | | |
|---|---|---|
| Re. 31,767 | 12/1984 | Brooks . |
| 3,826,301 | 7/1974 | Brooks . |
| 3,902,544 | 9/1975 | Flemings et al. . |
| 3,909,921 | 10/1975 | Brooks . |
| 4,088,178 | 5/1978 | Ueno . |
| 4,347,889 | 9/1982 | Komatsu et al. . |
| 4,431,046 | 2/1984 | Phillips . |
| 4,485,834 | 12/1984 | Grant . |
| 4,494,461 | 1/1985 | Pryor et al. . |
| 4,569,218 | 2/1986 | Baker et al. . |
| 4,621,676 | 11/1986 | Stewart . |
| 4,687,042 | 8/1987 | Young . |
| 4,754,801 | 7/1988 | Ueno . |
| 4,779,802 | 10/1988 | Coombs . |
| 4,804,034 | 2/1989 | Leatham . |
| 4,905,749 | 3/1990 | Mihara . |
| 4,961,457 | 10/1990 | Watson . |
| 4,971,133 | 11/1990 | Ashok . |
| 4,977,950 | 12/1990 | Muench . |
| 4,993,474 | 2/1991 | Uchida . |
| 5,381,847 | 1/1995 | Ashok . |

FOREIGN PATENT DOCUMENTS

| | | | |
|---|---|---|---|
| 63-108957 | 5/1988 | Japan | 164/312 |
| 1-178345 | 7/1989 | Japan | 164/900 |

OTHER PUBLICATIONS

Backman, Daniel Gustav, The Machine Casting of High Temperature Semi–, Solid Metals, Doctoral Thesis, Massachusetts Institute of Technology, Aug. 11, 1975, pp. 57–64.

*Primary Examiner*—Kuang Y. Lin
*Attorney, Agent, or Firm*—Gary N. Speed; Mark A. Rogers

[57] ABSTRACT

A method for the forming of semi-solid nucleated metallic alloys that have been sprayed in molten form into a container for intermediate casting. According to the present invention, a molten stream of metallic alloy is disrupted into a plurality of molten metallic alloy droplets, and the droplets are partially solidified as a plurality of degenerative dendritic globules so that approximately 5% to 60% by volume of each average degenerative dendritic globule is solid and the remainder is molten. The partially solidified globules are collected to form a semi-solid mass, and a portion of the semi-solid mass is forced into a die cavity prior to solidification to form a shaped metallic alloy.

4 Claims, 9 Drawing Sheets

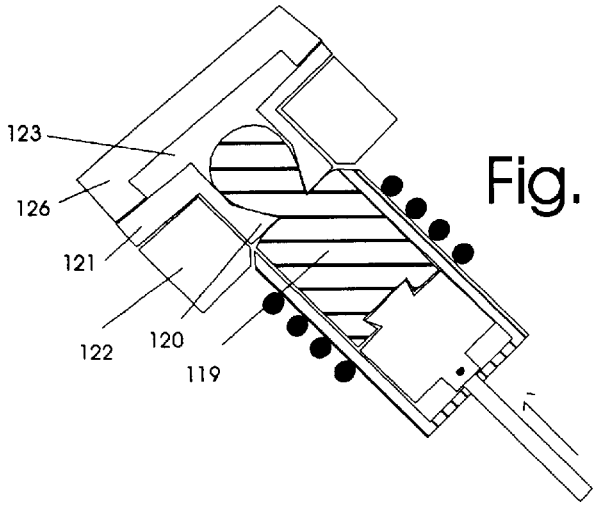
Fig. 2a
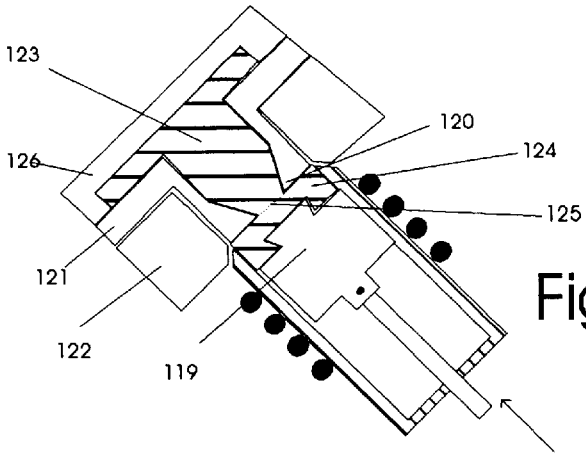
Fig. 2b
Fig. 2c
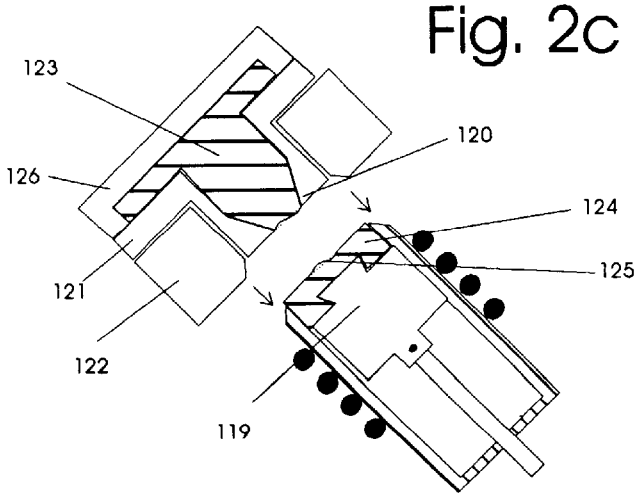

Prior Art from Ueno, U.S. Pat. No. 4,088,178

Prior Art from Ueno, U.S. Pat. No. 4,088,178

METHOD AND APPARATUS FOR NUCLEATED FORMING OF SEMI-SOLID METALLIC ALLOYS FROM MOLTEN METALS

I. CROSS-REFERENCES TO RELATED APPLICATIONS (if any)

None

II. STATEMENT AS TO RIGHTS TO INVENTIONS MADE UNDER FEDERALLY SPONSORED RESEARCH AND DEVELOPMENT (if any)

None

III. BACKGROUND OF THE INVENTION

A. Field of Invention

The present invention includes a method and apparatus for nucleated forming of metallic alloys, representing an improvement over prior art related to nucleated casting of similar materials. "Nucleated casting" is the process of spray casting molten metallic alloys in a controlled manner to form a semi-solid metallic alloy mixture with a uniform degenerative dendritic globule structure that solidifies into billet, rods or strips. "Nucleated forming" is the process of forming by die casting or die forging semi-solid nucleated cast metallic alloy mixture into molded parts.

B. Description of the Related Art

U.S. Pat. No. 5,381,847 (Ashok) for a Vertical Casting Process discloses a method for casting molten metallic alloys by spraying liquid alloys through a disruption site to atomize the liquid in a nonreactive gas environment and form droplets of alloy that solidify within a mold. This process called "nucleated casting" results in solidified alloys that possess a uniform, nondendritic structure. Ashok discloses and claims the method for nucleated casting whereby the partially solidified droplets are collected and solidified in a mold, but it does not anticipate immediately transferring a formed semi-solid mass under pressure into a die while in a semi-solid state. The current method and apparatus represent an improvement of the Ashok patent.

Ashok discloses a casting apparatus, including a molten metal source which may be a transfer lauder, conduit or other means known in the art. As disclosed, a disruption site is positioned to receive a stream of molten metal of a desired composition and convert that stream into a plurality of molten metal droplets. To prevent the droplets from oxidizing, or with aluminum alloys or magnesium, becoming a fire hazard, Ashok teaches that the molten metal source delivers the stream of molten metal to the disruption site in a controlled atmosphere. Ashok teaches that the controlled atmosphere may be any gas or combination of gases that does not react with the molten metal stream, although generally any noble gas or nitrogen is suitable. Other than alloys prone to excessive nitriding, nitrogen is preferred due to its low cost. When the molten metal stream is a copper based alloy, preferred controlled atmospheres are nitrogen, argon and mixtures thereof When the molten stream is a nickel-based alloy or a steel, the preferred controlled atmospheres are nitrogen or argon.

Ashok discloses methods for disruption of the stream of liquid metal alloy to form the atomized spray of metal, including gas atomization, magnetohydrodynamic atomization and mechanical type atomizers such as disclosed in U.S. Pat. No. 4,977,950 (Muench).

Ashok teaches that the droplets of molten metal are sprayed downward through a cooling zone in the shape of a diverging cone. The length of the cooling zone is determined to insure that an average droplet upon impact is at the required percentage of solid phase (generally five to 40 percent, and most preferably, from about 15–30 percent). Ashok also discloses that if the diameter of the mold is large, a plurality of disruption sites should be provided. The Ashok specification is incorporated herein by reference.

Ashok suggests that the process disclosed could be used for casting billets, rods and thin strips. Ashok does not teach the immediate use of the billet for die casting or die forging while the nucleated material is in a semi-solid state.

U.S. Pat. No. 3,826,301 (Brooks '301) discloses a method and apparatus for manufacturing shaped precision articles from molten metals or molten metal alloys, comprising directing an atomised stream of molten metal or molten metal alloy at a collecting surface to form a solid deposit, and working the deposit by means of a die to form a precision metal or metal alloy article. The deposit may be worked by a die pressing the deposit against the collecting surface, and the collecting surface may be a second die. Brooks '301 also discloses the metal may be sprayed into a container and then forced through a die in the bottom of the container for extrusion or, alternatively, through a shaped orifice in the ram for indirect extrusion.

U.S. Pat. No. 3,909,921 (Brooks '921) is a continuation-in-part of Brooks '301. Brooks '921 discloses that the hot deposit can be removed from the collection die by means of an ejector and transferred directly to the bottom die of a drop-forging hammer for forging. It states alternatively that the deposit may be forged at a later time either with or without the addition of heat to produce a shaped and forged article.

Neither Brooks '301 nor Brooks '921 discloses the formation of an intermediate shot or slug in a container that is then die cast. Brooks '301 claims both a method and apparatus whereby the deposit is worked on the collecting surface. Brooks '921 teaches that the hot metal particles are directed at the collecting surface or die and then forged, either directly on the surface or in a forging die.

U.S. Pat. No. 4,088,178 (Ueno) discloses a vertical die casting machine in which molten metal contained in a vertical casting sleeve located beneath a stationary platen is forced upward into the die cavity. In one embodiment, the casting sleeve is tilted for filling purposes and then moved to the vertical position for casting. This patent teaches a mechanism for tilting the container from a filling position to a casting position. See FIG. 3. Another embodiment of Ueno discloses a horizontal transport mechanism. See FIG. 4.

IV. BRIEF SUMMARY OF THE INVENTION

The current methods of die casting may be categorized in several ways, e.g, (1) vertical molten metal casting, (2) vertical semi-solid metal casting, (3) horizontal molten metal casting, and (4) horizontal semi-solid metal casting. Horizontal casting has certain advantages generally over vertical casting because it allows use of a vertical parting line to the die halves. When the die parts vertically, flush or trash material may be blown out of the die halves more quickly to prepare it for another filling cycle. Further, fragments drop out of the mold into a receptacle rather than into the other half of the die cavity.

Semi-solid metal ("SSM") casting has the significant advantage of creating parts of nondendritic microstructure that create stronger metal parts. SSM casting requires less energy to heat the billet for molding, although the creation of SSM billet requires additional energy and the SSM billet is more expensive than solid cast alloys. SSM billet is a thixotropic material that has been formed from stirred molten metal to form degenerative dendritic globules of the primary solid surrounded by the secondary solid. Thixotropic billet is reheated to liquefy a portion of the mixture of primary solid and secondary solid to enable the primary solid to freely flow under pressure into a die cavity.

"Primary solid" means the phase or phases solidified to form discrete degenerate dendrite particles as the temperature of the melt is reduced below the liquidus temperature of the alloy into the liquid-solid temperature range prior to casting the liquid-solid mixture formed. "Secondary solid" or "eutectic" means the phase or phases that solidify from the liquid existing in the mixture at a lower temperature than that at which the primary solid particles are formed.

The current method of SSM casting requires the following steps: (1) purchasing special thixotropic billet with the required microstructure of primary solid; (2) cutting billet to the required slug length; (3) reheating the slug to reliquefy the secondary solid and the required percentage of primary solid; (4) physically transferring the slug to the shot well of the clamping device; (5) pushing the slug into the die cavity; (6) allowing the molded part to freeze; (7) extracting the molded part from the die cavity, and (8) trimming and selling the excess metal (offal) to a third party for scrap value.

The nucleated forming process claimed requires the following steps: (1) purchasing solid cast ingot, rather than thixotropic material; (2) melting ingot in a holding furnace; (3) spraying material into container to form a semi-solid mass; (4) transferring the semi-solid mass under pressure into die cavity; (5) allowing molded part to freeze; (6) extracting molded part from die cavity, and (7) trimming the excess metal (offal) and remelting it in a furnace for in-house recycling.

The nucleated forming process claimed has the following advantages:

(1) Eliminating need for expensive thixotropic billet; (2) Use of widely available, low-cost cast ingot available from multiple sources; (3) Eliminating the cutting of billet into slugs; (4) Eliminating the reheating of the slug; (5) Eliminating melt loss at slug reheating; (6) Allowing usage of higher percentage liquid of the semi-solid mass during manufacture; (7) Allowing greater ability to vary the percentage solid; (8) Improving the capability of utilizing a variety of alloys; (9) Eliminating the need to sell offal for scrap and off-site recycling; (10) Improving the microstructural homogeneity of the final product; (11) Reducing oxides contained in final product because lower percent of material comes into contact with normal atmosphere; and (12) Making utilization of metal matrix composites possible because they are made at point of manufacture.

The nucleated forming process has the disadvantages that (1) alloys must be melted prior to manufacture and (2) an oxygen-free atmosphere must be used during the manufacture of the semi-solid mass.

The present invention also eliminates the need for a separate oxide stripper. The elimination of the oxide stripper has additional advantages. It (1) decreases the number of moving parts and the resulting cost of operations; (2) allows an increased number of runners and die cavities; (3) allows faster cycling; (4) leaves a residual biscuit attached to the conical projection of the piston to encourage welding to the piston as it pulls away from the nozzles; (5) eliminates additional parts for the oxide stripper.

The present invention is a method and apparatus for the combination of casting molten metals or metallic alloys to form nucleated cast material and the forming of shaped articles while the nucleated cast material remain in a semi-solid state.

One object of the present invention is to provide a method for the immediate working of nucleated cast molten metals and metallic alloys while the materials remain in a semi-solid state between the solidus and liquidus temperatures of the mixture.

Another object of the invention is to provide a container piston that is capable of retaining a biscuit of the nucleated metallic alloy being formed in the nucleated casting portion of the process to provide better welding of the material to the piston and allow it to pull the material in the container away from the disruption site.

Another object of the invention is to provide a restricted orifice at the opening into the die cavity to create a stress plane for separating the shaped metal article from the biscuit that will be retained on the end of the piston. The restricted orifice will also serve to eliminate the oxide stripper found at the opening leading to the die cavity from the container. The oxide stripper is generally a two piece metal device that must part along a plane aligned with the line of movement for the piston. The orifice described will enable the completed part to be removed from the die cavity without the separation of the oxide stripper in order to release the residual metal that solidifies between the piston and the die cavity and comprises the biscuit. In the present invention, the biscuit will separate at the stress plane created at the orifice, allowing the two pieces to be removed without parting the orifice used in lieu of the oxide stripper. The need for an oxide stripper is further reduced by the formation of the semi-solid mass in an oxygen free or an oxygen deficient environment.

These and other objects of the invention will be apparent to those skilled in this art from the following detailed description of a preferred embodiment of the invention.

V. BRIEF DESCRIPTION OF THE DRAWINGS

The invention will be further described in connection with the accompanying drawings, in which:

FIG. 1 is a section view of one embodiment of the invention, showing the container preparing to dock at the nucleated casting position relative to the nucleated forming position.

FIG. 1*a* is a section view of the container at the beginning of the nucleated casting cycle before the spraying of nucleated material.

FIG. 1*b* is a section view of the container being filled with metallic alloy during the nucleated casting cycle as the piston is withdrawn.

FIG. 2 is a section view of one embodiment of the invention, showing the container in the nucleated forming position as it docks with the die and platen.

FIG. 2*a* is a section view of the container in the nucleated forming position as the piston begins its forward stroke.

FIG. 2*b* is a section view of the container in the nucleated forming position as the piston completes its forward stroke.

FIG. 2*c* is a section view of the container as it shears the frozen metallic alloy approximately at the stress plane and departs from the nucleated forming position to return to the nucleated casting position.

Figure 8A:
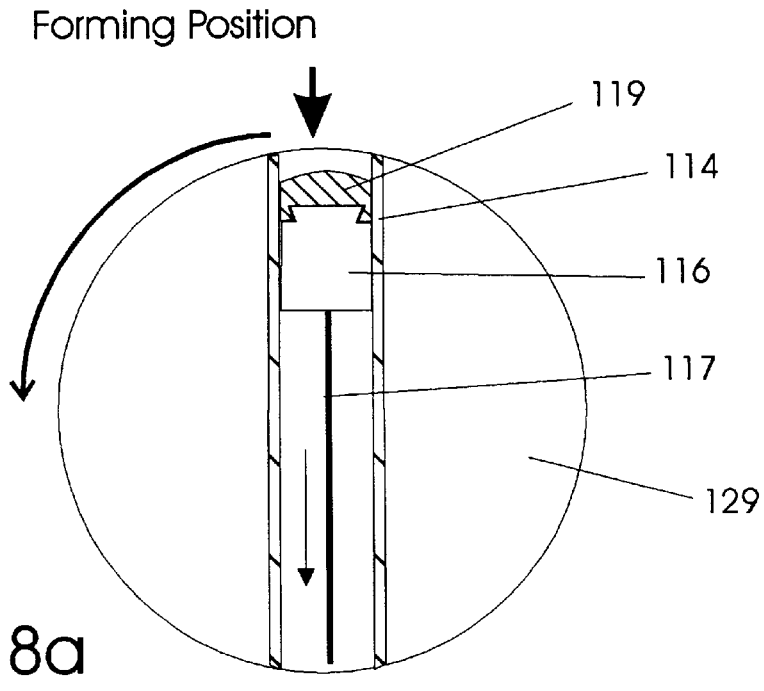

FIG. 8*a* is a section view of another embodiment of a container transport mechanism in the nucleated forming position.

Figure 8B:
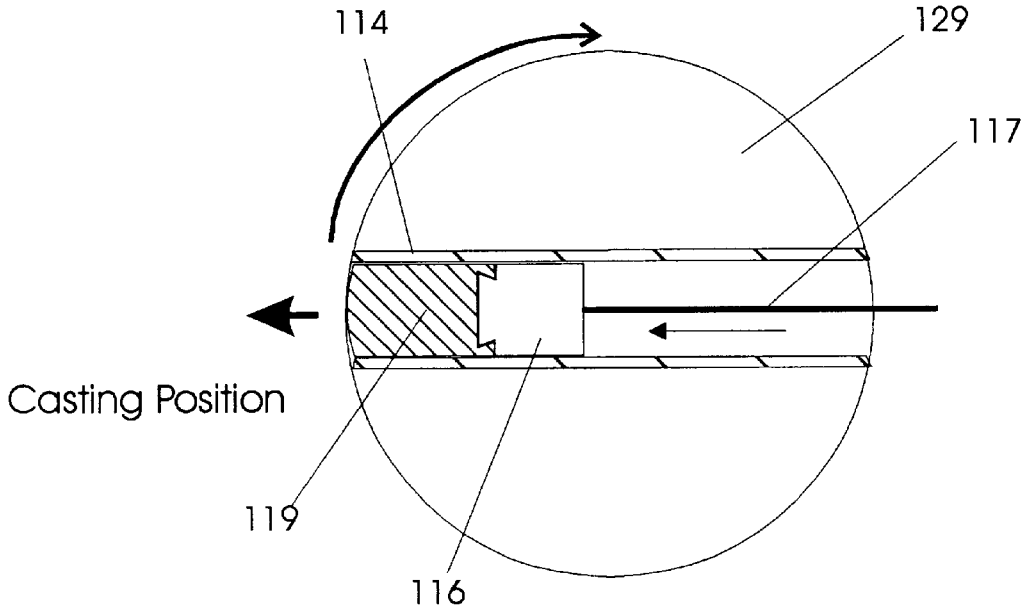

FIG. 8*b* is a section view of another embodiment of a container transport mechanism in the nucleated casting position.

VI. DETAILED DESCRIPTION/DESCRIPTION OF THE PREFERRED EMBODIMENT

The process represents an improvement of the vertical casting process disclosed in U.S. Pat. No. 5,381,847 Ashok. The process further comprises the forming of molded parts upon the formation of a semi-solid mass of degenerative dendritic globules in a temperature controlled container by the prompt transfer of the heated semi-solid mass under pressure into the mold. The process disclosed in Ashok allows the formation of shaped metallic pieces such as rods, billets and ingots possessing a uniform nondendritic structure. For purposes of the present process, the intermediate metal pieces will be called semi-solid masses.

Figure 1:
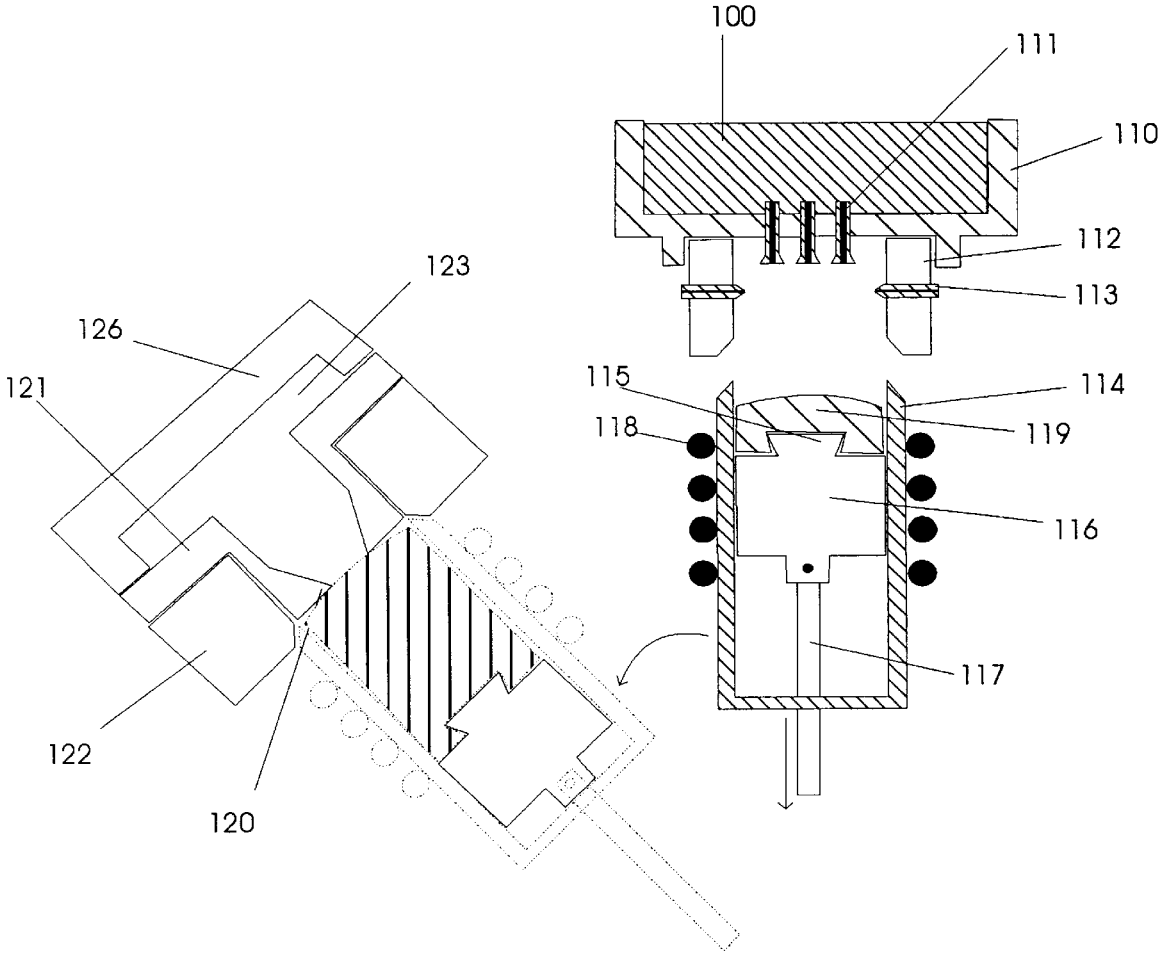
Figure 1A:
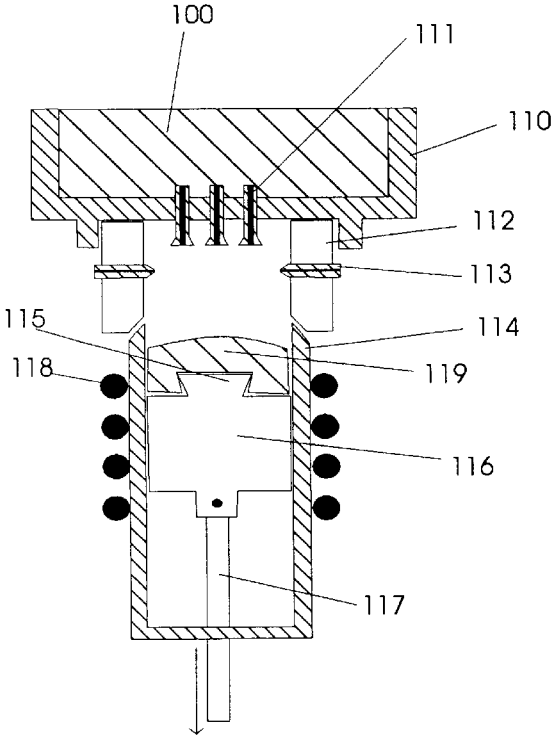
Figure 1B:
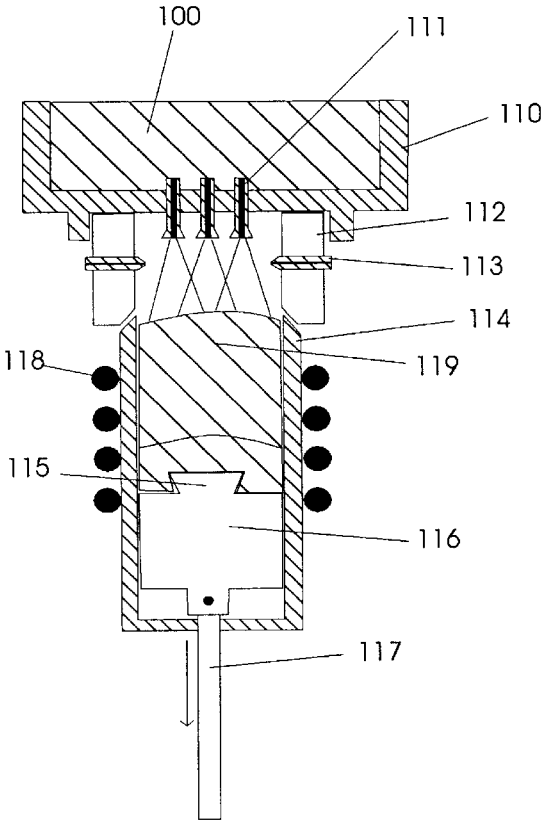

The new process comprises the spraying of molten metal through one or more liquid outlets 111 into an oxygen-free or oxygen-reduced environment within a container 114, preferably a temperature controlled shot sleeve. See FIGS. 1, 1*a* and 1*b*. A ring 112 with gas outlets 113 engages the liquid reservoir 110 (or a conducting means from the liquid reservoir 110) and a container 114 to allow the metallic alloy 100 flow through the liquid outlets 111 into the container 114. The molten metallic alloy 100 is disrupted in any of the ways suggested by Ashok, e.g. by gas injected into the ring 112 through gas outlets 113. A piston 116 at the opposing end of the container 114 pulls away from the liquid outlets 111 as the metallic alloy 100 is sprayed into the container 114 and solidifies or freezes on the surface of the piston 116 to form the semi-solid mass 119 of degenerative dendritic globules. The piston 116 slides within the container 114 and the end of the piston preferably has a surface projection 115 or a plurality of projections to help grasp the semi-solid mass 119 and help pull it with the piston 116. The projection 115 is preferably conical with the base protruding into the container 114. The diameter of the base of the conical projection 115 is less than the diameter of piston 116 to allow metal to form between the conical projection and the container wall. The protection 115 allows a semi-solid mass 119 to form as the droplets of molten metal alloy 100 are deposited as degenerative dendritic globules on the surface of the projection or on the surface of the biscuit 124 attached to it at the opposing end of the container 114 from the liquid outlets 111.

Figure 2:
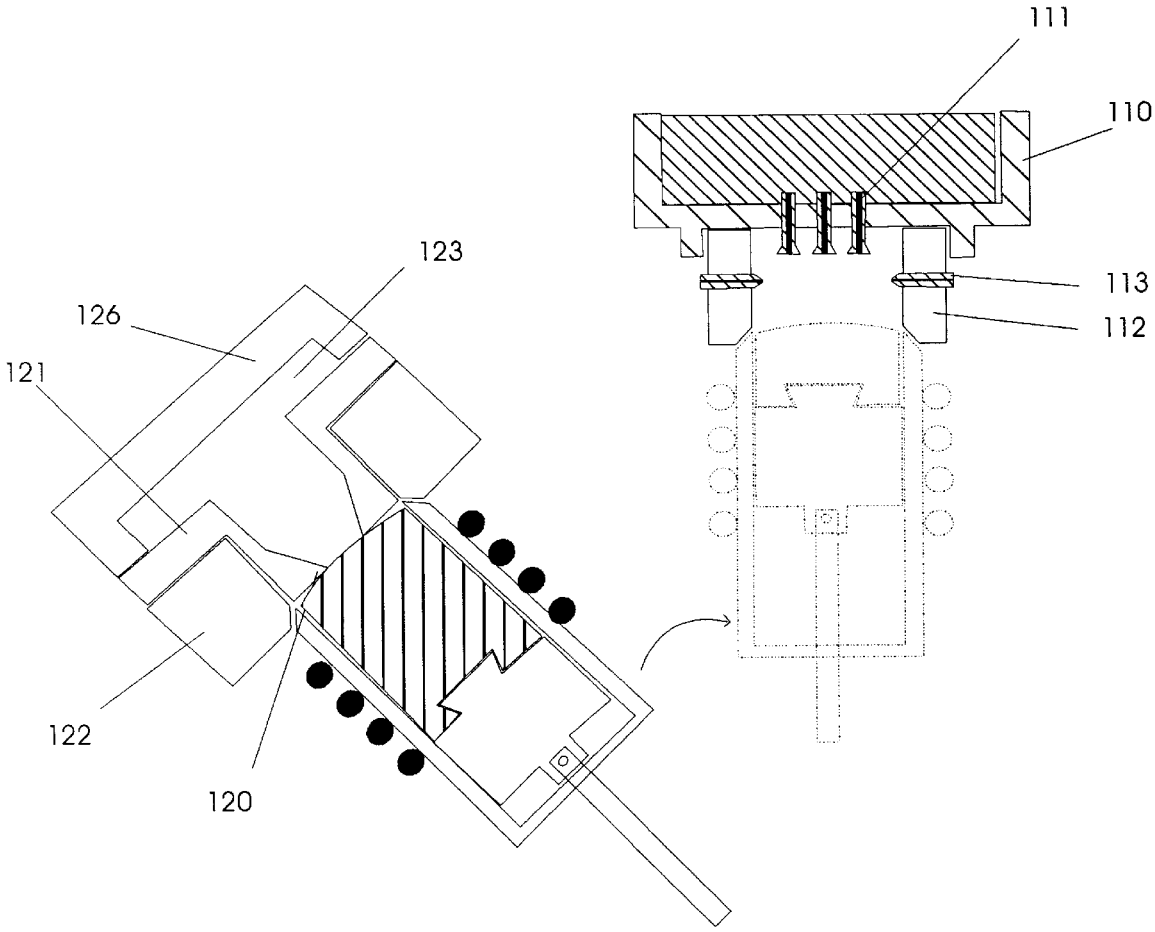

The piston 116 continues to withdraw away from the liquid outlets within the container 114 to pull the semi-solid mass 119 until the required amount of material has been deposited in the container 114. See FIGS. 1*a* and 1*b*. The rate of withdrawal will be approximately equal to the rate of formation within the container so that the molten metallic alloy 100 is sprayed uniformly within the container 114. Upon completion of the formation process, the molten metallic alloy 100 stops flowing through the liquid outlets 111 and the semi-solid mass 119 begins to freeze. The container 114 then undocks from its initial position adjacent to a ring 112 surrounding the liquid outlets and the container is then moved to a second docking position at the orifice 120 of a first die element 121. See FIGS. 2 and 2*a*. The container 114 docks with the first die element 121 and platen 120 and the piston 116 and driving shaft 117 transfer the semi-solid mass 119 under pressure into the die cavity 123. See FIG. 2*b*.

The semi-solid mass will be transferred under pressure through the orifice 120 into the die cavity 123. See FIG. 2. In the preferred embodiment, the orifice 120 should have a diameter less than the diameter of the piston 116, and the orifice diameter increases as it opens into the die cavity 123 away from the container 114. The smaller diameter of the orifice in closest proximity to the container and piston will create a stress plane 125 perpendicular to the direction of metal movement from the container 114 to the die cavity 123. After the metal has been transferred into the die cavity 123 and allowed to freeze, the container 114 will be withdrawn from the second docking position, causing the metal to tear approximately at the stress plane 125, with a biscuit 124 of the metal remaining attached to the projection 115 on the piston 116. See FIG. 2*c*. The container 114 will then be returned to the initial docking position. Upon redocking, the container 114 will be filled with gas to eliminate or substantially reduce the oxygen in the formation environment, the liquid outlets 111 will be reopened to allow the molten metallic alloy 100 to be sprayed into the container 114, and the piston 116 will begin to withdraw as a new semi-solid mass 119 is formed on the surface of the residual biscuit 124 in a new cycle of the process. In the preferred embodiment, the container 114 is surrounded by heating elements 118 to maintain a controlled temperature of the nucleated cast semi-solid mass 119 and the residual biscuit 124 so that they will be at the required percentage of liquid phase.

Figure 3:
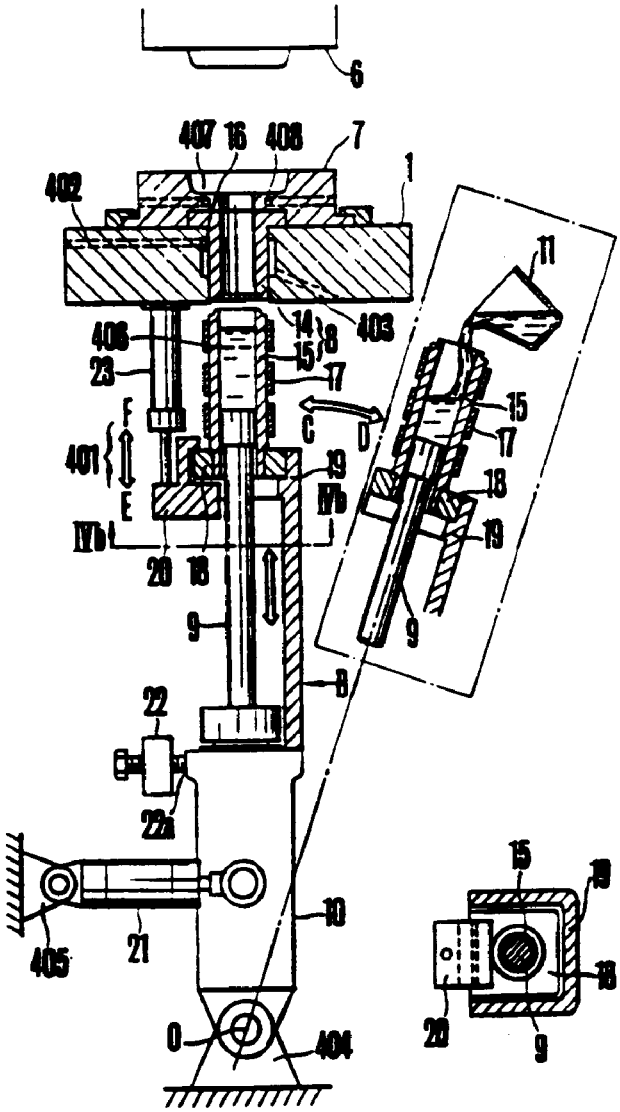
FIG. 3 is a section view of one embodiment of a possible container transport mechanism from the prior art.

The mechanism for the transfering the container may be configured in various embodiments. One embodiment is based upon an apparatus disclosed in U.S. Pat. No. 4,088,178 Ueno for a vertical die cast machine. See FIG. 3. This embodiment involves tilting the device disclosed in Ueno so that the formation of the semi-solid mass occurs in the vertical position and the container is then tilted to a second position 30–45° off of vertical for the die casting step. FIG. 3 shows this mechanism whereby molten metal under the prior art was poured into a lower sleeve 15 containing a heating device 17. These elements along with an injection plunger 9, a ring 18, support 19 and casting sleeve 8 tilt on a pivot point of a pedestal 404 from a filling position to a casting position moved by a pressurized oil cylinder attached to a pedestal 405. The injection plunger 9 forces the molten metal through a hole in the platen 1 into a cavity 407 surrounded by a cooling conduit 408, water supply conduit 402 and water exhaust conduit 403, and a molded article is formed between the movable die 6 and the stationary die 7.

In an alternative embodiment disclosed by Ueno, the molten metal could be transported into place by a horizontal guide plate or rail 24. The piston rod 28 of the oil pressure cylinder 27 secured to the guide rail 24 pushes a coupling 26 on the ring 18 to move the lower sleeve 15 into place for vertical forming. See FIG. 4.

Figure 4:
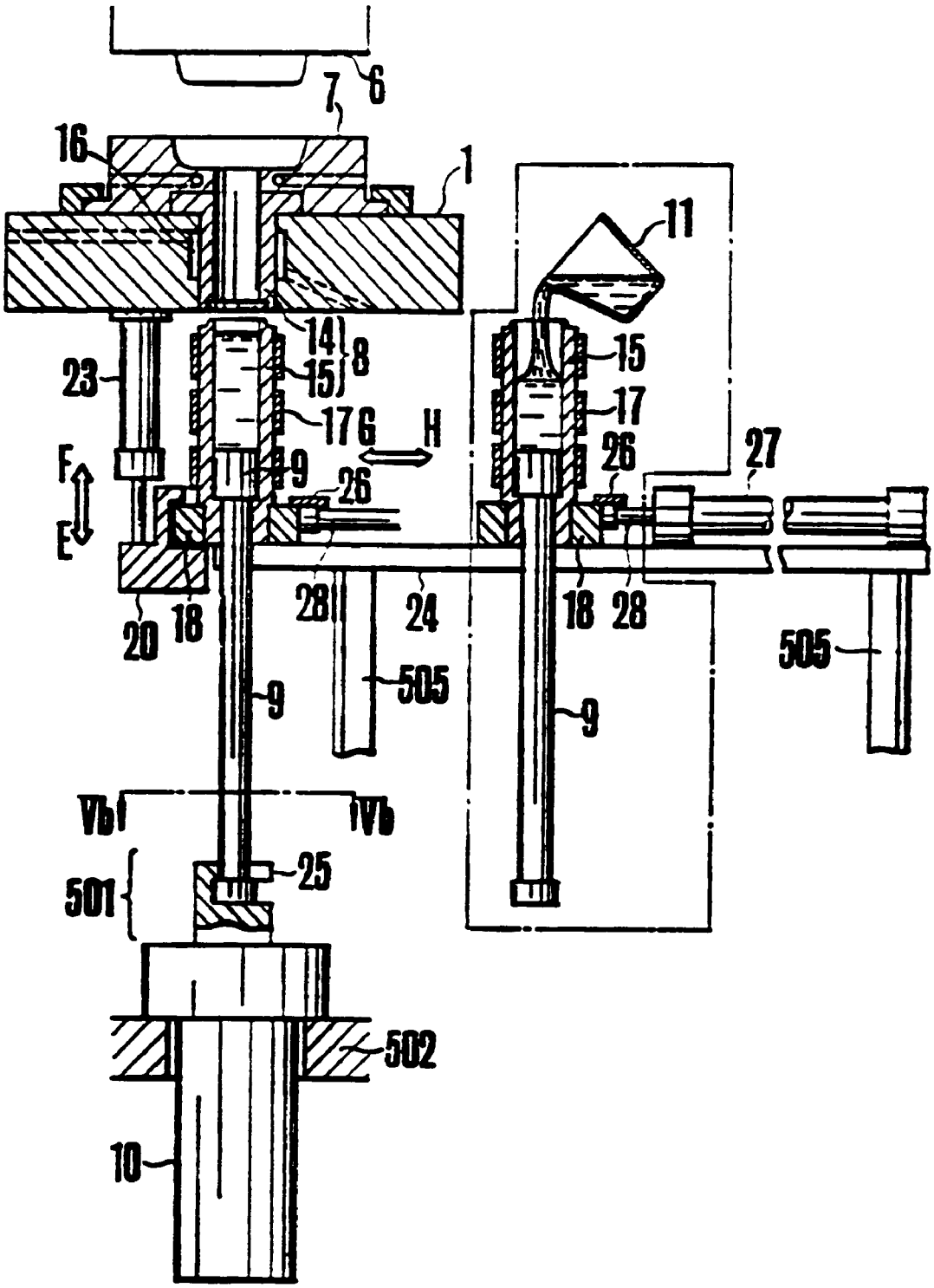
FIG. 4 is a section view of another embodiment of a possible container transport mechanism from the prior art.
Figure 5:
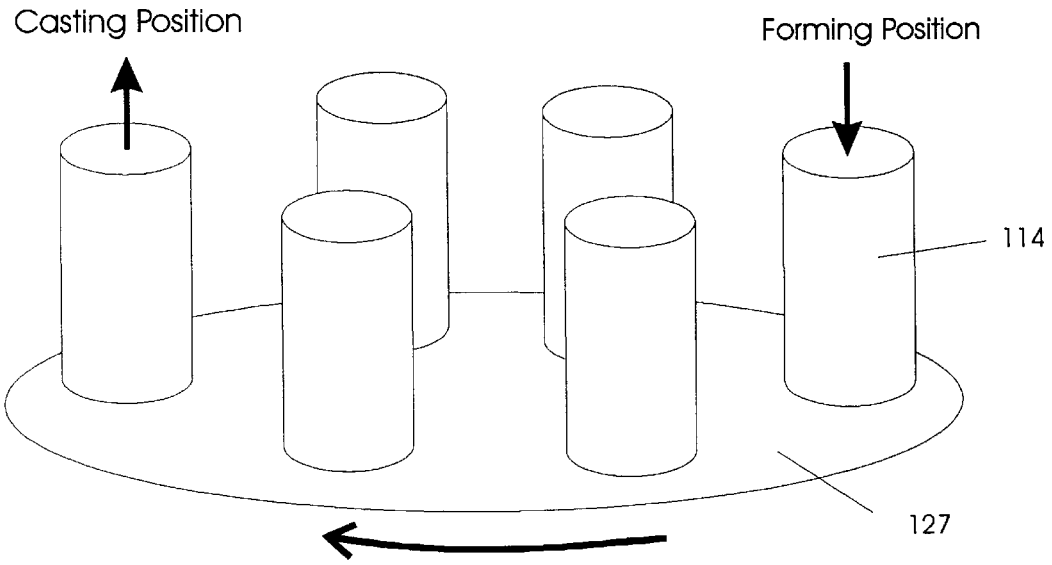
FIG. 5 is a perspective view of another embodiment of a container transport mechanism.
Figure 6:
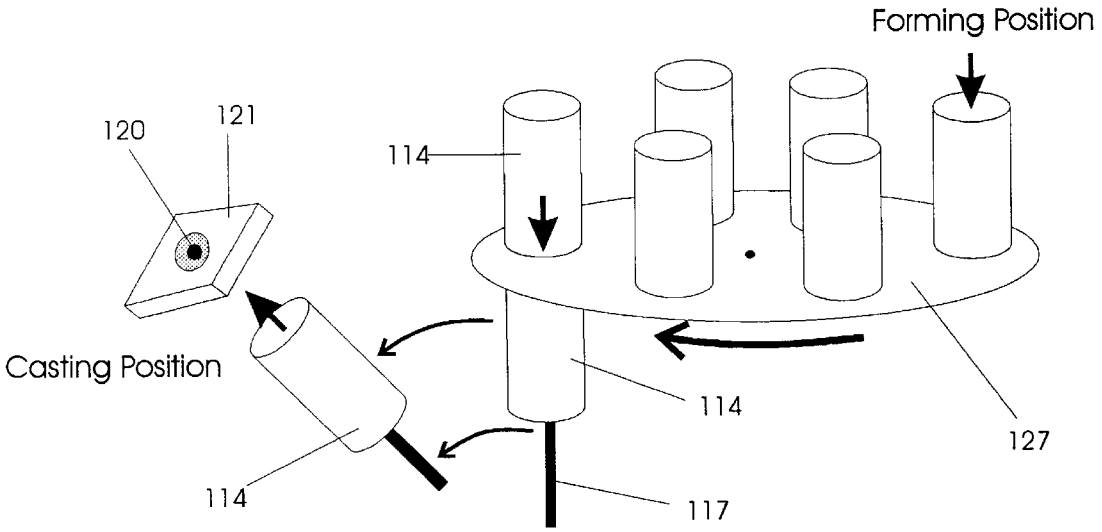
FIG. 6 is a perspective view of another embodiment of a container transport mechanism.
Figure 7:
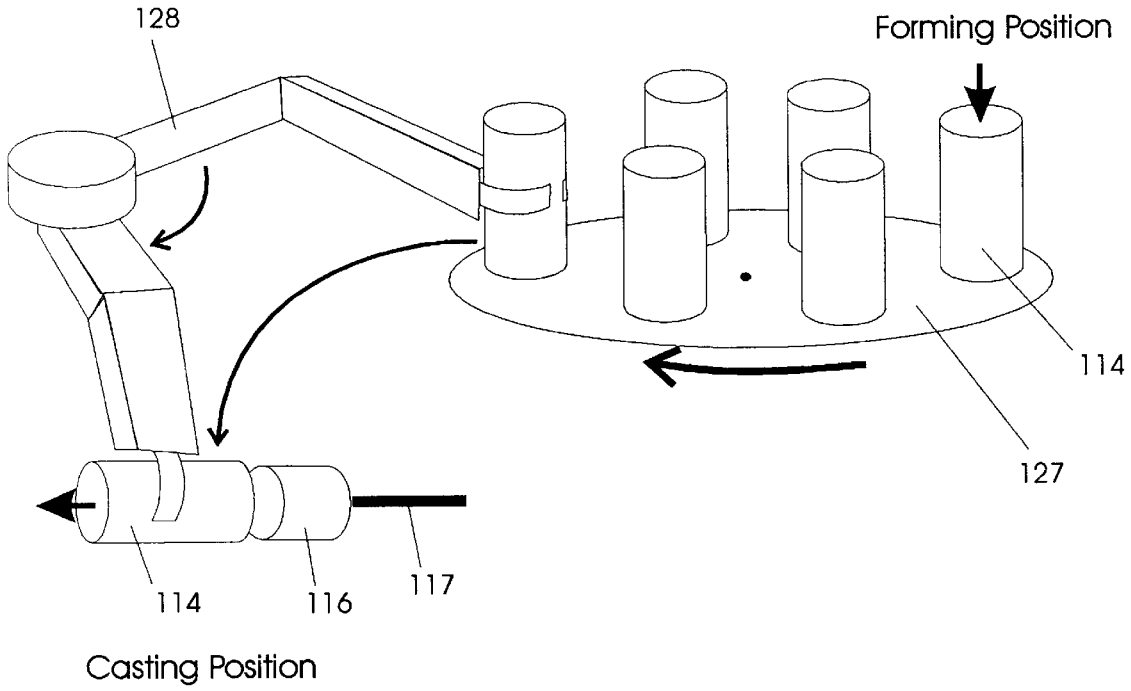
FIG. 7 is a perspective view of another embodiment of a container transport mechanism.

Alternative embodiments of the transfer mechanism used to move the container from the initial docking to the secondary docking position include (1) a rotary configuration of a plurality of parallel containers that circulate on a perpendicular horizontal plane such that at each incremental stop in the circular rotation one container is positioned under the metallic alloy disruption site and another container is positioned under the vertical die cast machine (See FIGS. 4 and 5); (2) a rotary configuration of a plurality of parallel containers that circulate on a perpendicular horizontal plane such that at each incremental stop in the circular rotation one container is positioned under the metallic alloy disruption site and another container is positioned so that the semi-solid mass may be withdrawn and tilted into the casting position (see FIG. 6); (3) a rotary configuration of a plurality of parallel containers that circulate on a horizontal plane such that at each incremental stop in the circular rotation one container is positioned under the metallic alloy disruption site and another container is positioned for transfer using a robot arm 128 (see FIG. 7); and (4) a rotary configuration of a singular container that rotates in a vertical plane, either spinning in a singular direction from the filling position to the casting position and then back to the filling position or reciprocating back and forth within the plane between the two positions (see FIGS. 8*a* and 8*b*).

The furnace to heat the metal to a molten state comprises a charging chamber, a holding chamber and a feeding chamber. Ingot bundles are fed into the charging chamber to preheat the material to approximately 750° F.

The preferred temperature ranges for forming the semi-solid mixture are 1070°–1220° F. for aluminum alloys, 820°–1210° F. for magnesium alloys, and 1655°–1990° F. for brass alloys.

The cycle time of the preferred embodiment is approximately 40 seconds. Formation of the semi-solid mass requires approximately 20 seconds. Undocking from the filling position, transfer of the semi-solid mass to the molding position and redocking will require about four seconds. Transferring the metal into the mold requires about two seconds. After approximately two seconds, the piston and residual biscuit is withdrawn and returned to the initial position in about four seconds. An additional eight seconds is incorporated for die opening, part removal and spraying before the cycle begins again.

The docking and undocking of the container will require the container to tilt about 45° in the preferred embodiment and move in and dock with the die once the sleeve is tilted to the proper orientation.

What is claimed is:

1. A method for casting a shaped metallic alloy article, comprising:

(a) disrupting a molten stream of metallic alloy into a plurality of molten metallic alloy droplets;

(b) partially solidifying said molten metallic alloy droplets as a plurality of degenerative dendritic globules such that from about 5% to about 60% by volume of each average degenerative dendritic globule is solid and the remainder is molten;

(c) collecting said partially solidified degenerative dendritic globules in a container forming a semi-solid mass;

(d) moving said semi-solid mass within said container away from said molten stream of metallic alloy as said partially solidified degenerative dendritic globules are collected; and (e) forcing at least a portion of said semi-solid mass prior to solidification of all of said partially solidified degenerative dendritic globules into a die cavity to form a shaped metallic alloy article; and wherein step (c) further comprises collecting said partially solidified degenerative dendritic globules on a piston in said container and maintaining said semi-solid mass as partially solidified with a percentage solid composition of said degenerative dendritic globules between 5 percent and 60 percent, inclusive; and wherein step (d) further comprises moving said piston away from said molten stream of metallic alloy to move said semi-solid mass within said container away from said molten stream of metallic alloy as said partially solidified degenerative dendritic globules are collected.

2. A method for casting a shaped metallic alloy article, comprising:

(a) disrupting a molten stream of metallic alloy into a plurality of molten metallic alloy droplets;

(b) partially solidifying said molten metallic alloy droplets as a plurality of degenerative dendritic globules such that from about 5% to about 60% by volume of each average degenerative dendritic globule is solid and the remainder is molten;

(c) collecting said partially solidified degenerative dendritic globules in a container forming a semi-solid mass;

(d) moving said semi-solid mass within said container away from said molten stream of metallic alloy as said partially solidified degenerative dendritic globules are collected; and (e) forcing at least a portion of said semi-solid mass prior to solidification of all of said partially solidified degenerative dendritic globules into a die cavity to form a shaped metallic alloy article; and wherein step (c) further comprises collecting said partially solidified degenerative dendritic globules on a piston in said container; and further comprising transporting said semi-solid mass from a first position to a second position prior to advancing said piston to force a portion of said semi-solid mass into said die cavity.

3. A method for casting a shaped metallic alloy article, comprising:

(a) disrupting a molten stream of metallic alloy into a plurality of molten metallic alloy droplets;

(b) partially solidifying said molten metallic alloy droplets as a plurality of degenerative dendritic globules such that from about 5% to about 60% by volume of each average degenerative dendritic globule is solid and the remainder is molten;

(c) collecting said partially solidified degenerative dendritic globules in a container forming a semi-solid mass;

(d) moving said semi-solid mass within said container away from said molten stream of metallic alloy as said partially solidified degenerative dendritic globules are collected; and (e) forcing at least a portion of said semi-solid mass prior to solidification of all of said partially solidified degenerative dendritic globules into a die cavity to form a shaped metallic alloy article; and wherein said molten stream of metallic alloy is disrupted in a first plane and said partially solidified degenerative dendritic globules are collected at a second plane; and further comprising:

rotating said container on a horizontal plane to move said container to a filling position before step (c);

maintaining a distance between said first plane and said second plane substantially constant as said partially solidified degenerative dendritic globules are collected to form a semi-solid mass; and after step (c), rotating said container to a casting position while rotating a second container to a filling position.

4. A method for casting a shaped metallic alloy article, comprising:

(a) disrupting a molten stream of metallic alloy into a plurality of molten metallic alloy droplets;

(b) partially solidifying said molten metallic alloy droplets as a plurality of degenerative dendritic globules such that from about 5% to about 60% by volume of each average degenerative dendritic globule is solid and the remainder is molten;

(c) collecting said partially solidified degenerative dendritic globules in a container forming a semi-solid mass;

(d) moving said semi-solid mass within said container away from said molten stream of metallic alloy as said partially solidified degenerative dendritic globules are collected; and (e) forcing at least a portion of said semi-solid mass prior to solidification of all of said partially solidified degenerative dendritic globules into a die cavity to form a shaped metallic alloy article; and further comprising:

moving said container to a filling position before step (c);

after step (c), moving said container to a casting position and moving a second container to said filling position;

solidifying said partially solidified degenerative dendritic globules of said shaped metallic alloy article, and removing said shaped metallic alloy article.

* * * * *

UNITED STATES PATENT AND TRADEMARK OFFICE

CERTIFICATE OF CORRECTION

PATENT NO. : 6,068,043
DATED : May 30, 2000
INVENTOR(S) : Clark

It is certified that error appears in the above-identified patent and that said Letters Patent is hereby corrected as shown below:

Title page,
[*] delete "664" and insert -- 164 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*